US008313086B2

(12) United States Patent
Gray et al.

(10) Patent No.: US 8,313,086 B2
(45) Date of Patent: Nov. 20, 2012

(54) MULTIPLE AXLE LIFT SYSTEM AND METHOD

(75) Inventors: Joseph L. Gray, St. Joseph, MO (US); Raymond C. Chan, St. Joseph, MO (US)

(73) Assignee: Gray Manufacturing Company, Inc., St. Joseph, MO (US)

( * ) Notice: Subject to any disclaimer, the term of this patent is extended or adjusted under 35 U.S.C. 154(b) by 201 days.

(21) Appl. No.: 12/895,128

(22) Filed: Sep. 30, 2010

(65) Prior Publication Data

US 2012/0080653 A1 Apr. 5, 2012

(51) Int. Cl.
*B66F 5/00* (2006.01)

(52) U.S. Cl. ..... 254/2 B; 254/93 L; 254/134

(58) Field of Classification Search ..... 254/2 B, 254/2 C, 134, 93 H, 93 L; 414/426, 427
See application file for complete search history.

(56) References Cited

U.S. PATENT DOCUMENTS

| | | | | | |
|---|---|---|---|---|---|
| 2,740,607 | A * | 4/1956 | Branick | 254/93 H |
| 2,867,409 | A * | 1/1959 | Southerwick | 254/2 B |
| 2,868,501 | A * | 1/1959 | Cloud et al. | 254/93 HP |
| 2,937,002 | A * | 5/1960 | Schultz | 254/93 R |
| 2,947,513 | A * | 8/1960 | Nolden et al. | 254/2 B |
| 3,028,145 | A * | 4/1962 | Brand | 254/134 |
| 3,044,747 | A * | 7/1962 | Nolden | 254/2 B |
| 3,165,295 | A * | 1/1965 | Nolden | 254/2 R |
| 3,547,228 | A | 12/1970 | Wiley et al. | |
| 3,760,906 | A * | 9/1973 | McGee | 188/4 R |
| 4,432,531 | A * | 2/1984 | Bevans et al. | 254/100 |
| 6,164,414 | A | 12/2000 | Duty | |
| 6,315,079 | B1 | 11/2001 | Berends et al. | |
| 7,014,012 | B2 | 3/2006 | Baker | |
| 7,070,219 | B1 | 7/2006 | Kelly | |
| 7,581,713 | B1 * | 9/2009 | Voss | 254/2 R |
| 7,823,861 | B2 * | 11/2010 | Krug | 254/4 B |
| 8,141,850 | B2 * | 3/2012 | Drake | 254/4 B |
| 8,162,107 | B2 * | 4/2012 | Finkbeiner | 187/237 |
| 2005/0254923 | A1 * | 11/2005 | Gorski et al. | 414/426 |
| 2012/0080653 | A1 * | 4/2012 | Gray et al. | 254/89 R |

* cited by examiner

*Primary Examiner* — Lee D Wilson
*Assistant Examiner* — Joel Crandall
(74) *Attorney, Agent, or Firm* — Hovey Williams LLP

(57) ABSTRACT

A multiple axle lift system having a column mechanism and a carriage assembly is provided. The column mechanism has a base member with a central support member extending therefrom. The carriage assembly is slidably connected to the column mechanism and includes a centerline, a first lift pad assembly with a first lift pad for engaging a vehicle tire and a second lift pad assembly with a second lift pad for engaging a vehicle tire. The first and second lift pads are configured to face away from the centerline.

17 Claims, 7 Drawing Sheets

MULTIPLE AXLE LIFT SYSTEM AND METHOD

BACKGROUND OF THE INVENTION

1. Field of the Invention

The present invention relates to a multiple axle lift system. Specifically, the present invention is for a multiple axle lift system for lifting vehicle tires on separate vehicle axles.

2. Background Information

For vehicle repair and maintenance, it is often necessary to raise the vehicle above the ground to more easily reach parts of the vehicle that are inaccessible when the vehicle is resting on the ground.

One way of lifting a vehicle is by using a lift system stationed at each tire of the vehicle. The lift systems are coordinated through various means to lift the tires of the vehicle at relatively the same time and velocity. Each lift system has a column mechanism and a carriage assembly that is vertically movable along the column mechanism. The carriage assembly grasps the tire with a pair of protrusions to engage the tire. The column mechanism then lifts the carriage assembly using a hydraulic cylinder, for example.

The pair of protrusions that extend outwardly away from the carriage assembly are spaced apart at a distance less than the diameter of the tire such that, when lifting of the carriage assembly occurs, a portion of the tire is disposed between the protrusions.

Since there are many different vehicle tire diameters, frequent adjustments of the pair of protrusions is required so that they may properly grasp the tire. One method of adjusting carriage assemblies is manual adjustment of the protrusions to increase or decrease the space therebetween. The manual adjustment includes, for example, manually lifting and sliding each protrusion and then locking the protrusions into place. This is time consuming and, when performed inaccurately, can cause the dangerous situation of overloading one side of the carriage assembly.

For lifting a heavy vehicle with more than one rear axle, such as a dual-axle truck, a lift system is stationed at each tire of the vehicle. In the case of a vehicle with dual axles, six lift systems, one for each tire, are needed to lift the vehicle. This is expensive and time consuming since it requires the coordination of six lift systems with their respective carriage assemblies, including adjusting the carriage assemblies as described above with the added risk of side loading in one or more of the six lift systems.

In view of the above, it will be apparent to those skilled in the art from this disclosure that there exists a need for an improved lift system for multiple rear axle vehicles. This invention addresses this need in the art as well as other needs, which will become apparent to those skilled in the art from this disclosure.

SUMMARY OF THE INVENTION

It is an object of the present invention to provide a multiple axle lift system to lift tires on multiple axles.

In order to achieve the above mentioned objects and other objects of the present invention, a multiple axle lift system is provided that basically comprises a column mechanism and a carriage assembly. The column mechanism has a base member with a central support member extending therefrom. The carriage assembly has a carriage section configured to engage the vehicle tires and slidably coupled to the column mechanism. The carriage section has a centerline C and includes first and second lift pad assemblies extending from the carriage section. The first lift pad assembly has a first lift pad for contacting a side of a first vehicle tire and the second lift pad assembly has a second lift pad for contacting a side of a second vehicle tire in tandem with the first vehicle tire.

A multiple axle lift system is provided that basically comprises a column mechanism and a carriage assembly. The column mechanism has a base member with a central support member extending therefrom. The carriage assembly is slidably connected to the column mechanism and includes a centerline, a first lift pad assembly with a first lift pad for engaging a vehicle tire and a second lift pad assembly with a second lift pad for engaging a vehicle tire. The first and second lift pads are configured to face away from the centerline.

A method of lifting vehicle tires on separate axles is provided that basically comprises positioning a column mechanism and a carriage assembly at a vicinity of the vehicle tires; engaging the vehicle tires with a first lift pad assembly and a second lift pad assembly of the carriage assembly, wherein the vehicle tires are not disposed between the first and second lift pad assemblies; forwardly supporting the column mechanism between the tires; and raising the carriage assembly with the column mechanism.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF THE DRAWINGS

Referring now to the attached drawings that form a part of this original disclosure.

DETAILED DESCRIPTION

Figure 1B:
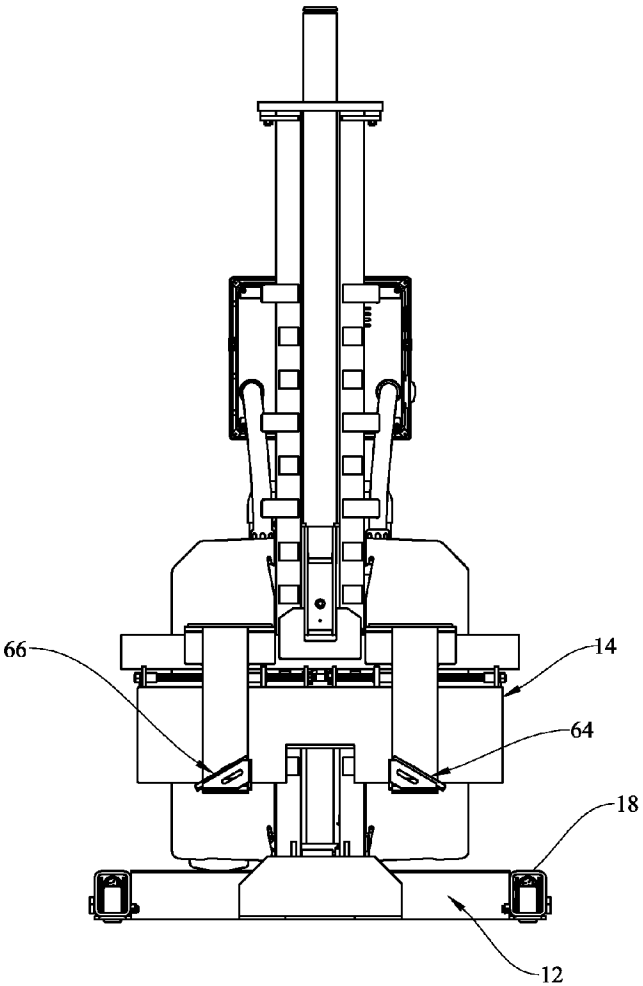
FIG. 1B is a front elevation view of the multiple axle lift system according to an embodiment of the invention.
Figure 1A:
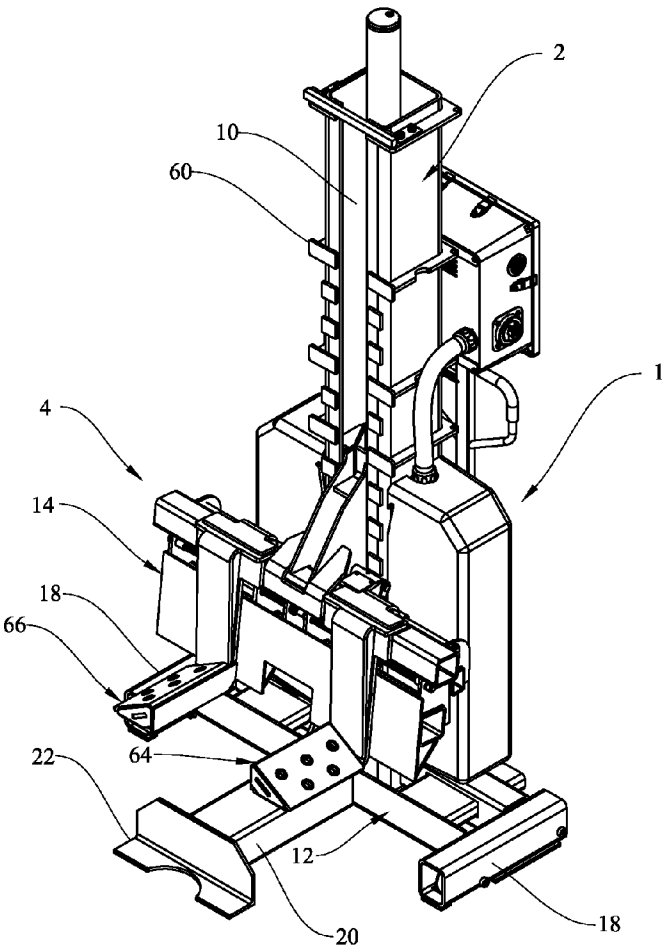
FIG. 1A is a front perspective view of a multiple axle lift system according to an embodiment of the invention.
Figure 1D:
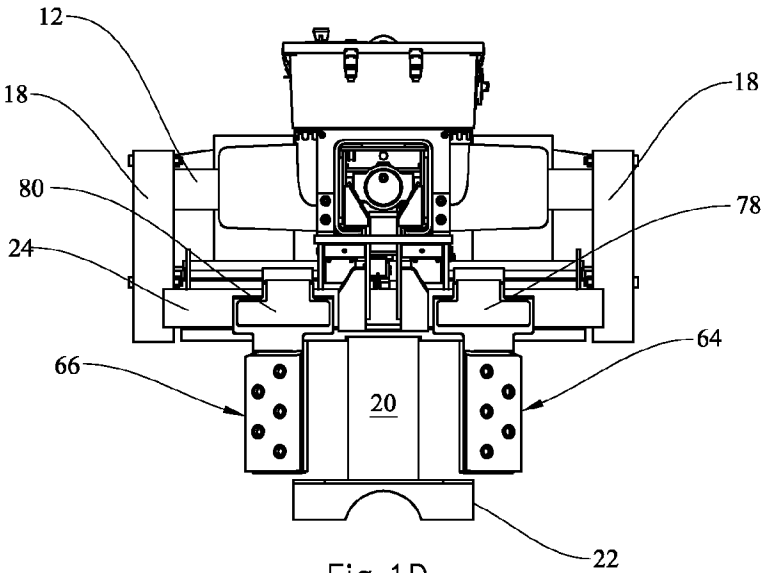
FIG. 1D is a top plan view of the multiple axle lift system according to an embodiment of the invention.
Figure 1C:
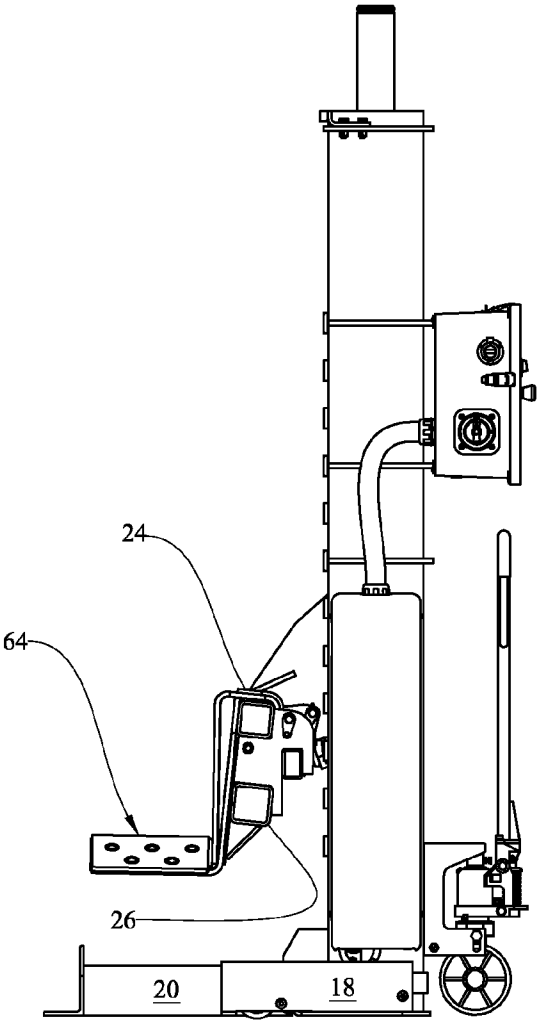
FIG. 1C is a side elevation view of the multiple axle lift system according to an embodiment of the invention.

A preferred embodiment of the present invention will now be explained with reference to the drawings. It will be apparent to those skilled in the art from this disclosure that the following description of the embodiment of the present invention is provided for illustration only and not for the purpose of limiting the invention.

Referring initially to FIGS. 1A-1D, a multiple axle lift system 1 is shown. The lift system 1 is preferably a portable lift system and more preferably, a wireless portable lift system for coordinated lifting with other lift systems 1. The lift system 1 has a column mechanism 2 and a carriage assembly 4. The carriage assembly 4 is configured to engage more than one vehicle tire 6, 8. The column mechanism 2 is configured to lift the carriage assembly 4 which lifts the vehicle tires 6, 8 that are attached to separate vehicle axles (not shown). Thus, the rear of a multiple axle vehicle can be lifted with two multiple lift axle systems 1. Although the tires 6, 8 are shown singularly mounted to the vehicle axles, it will be apparent to one of ordinary skill in the art from this disclosure that a pair of dual mounted tires, each on a separate axle, can be lifted by the present invention.

Figure 2B:
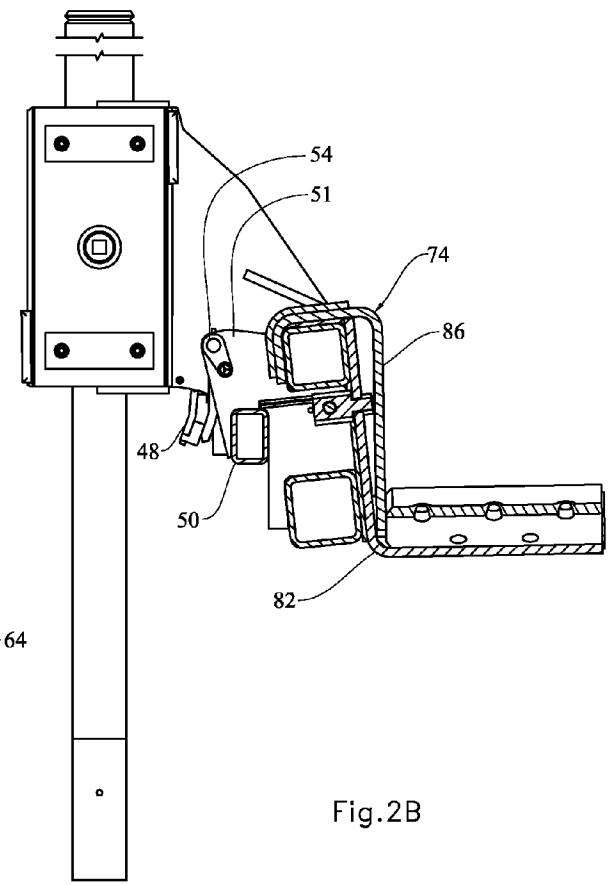
FIG. 2B is a partial cross-sectional view taken along lines B-B in FIG. 2A.
Figure 2A:
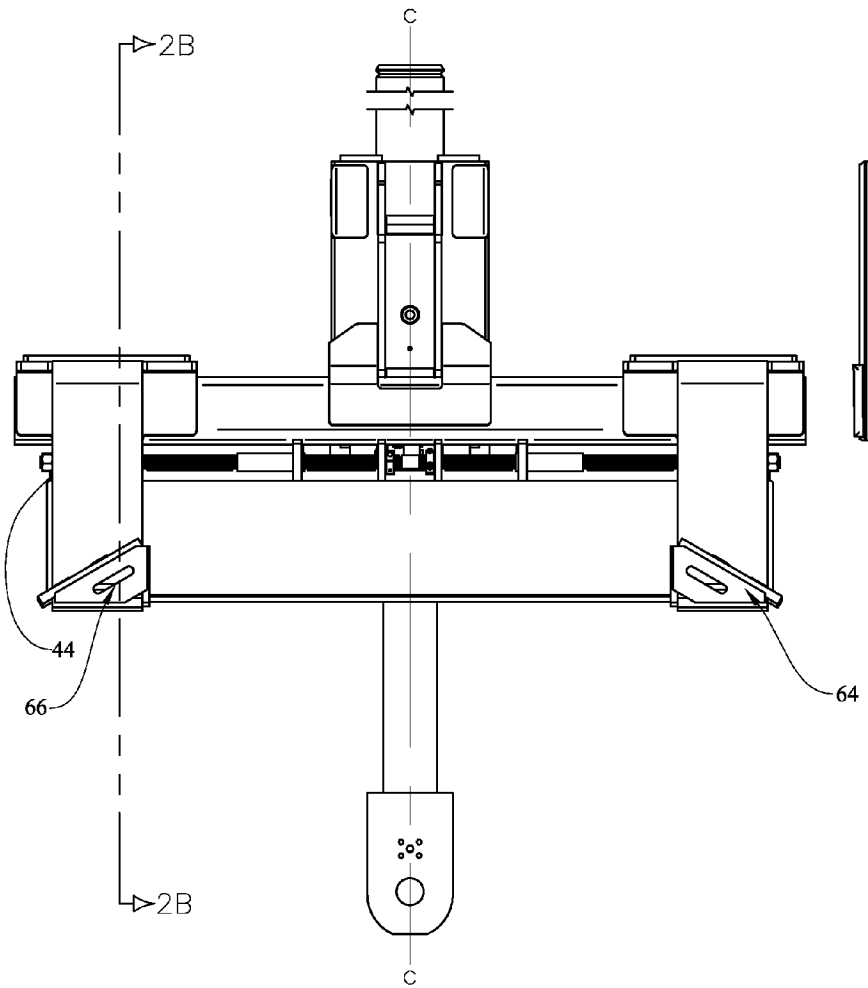
FIG. 2A is a front elevation view of the carriage assembly shown in FIGS. 1A-1D according to the embodiment of the present invention.
Figure 2C:
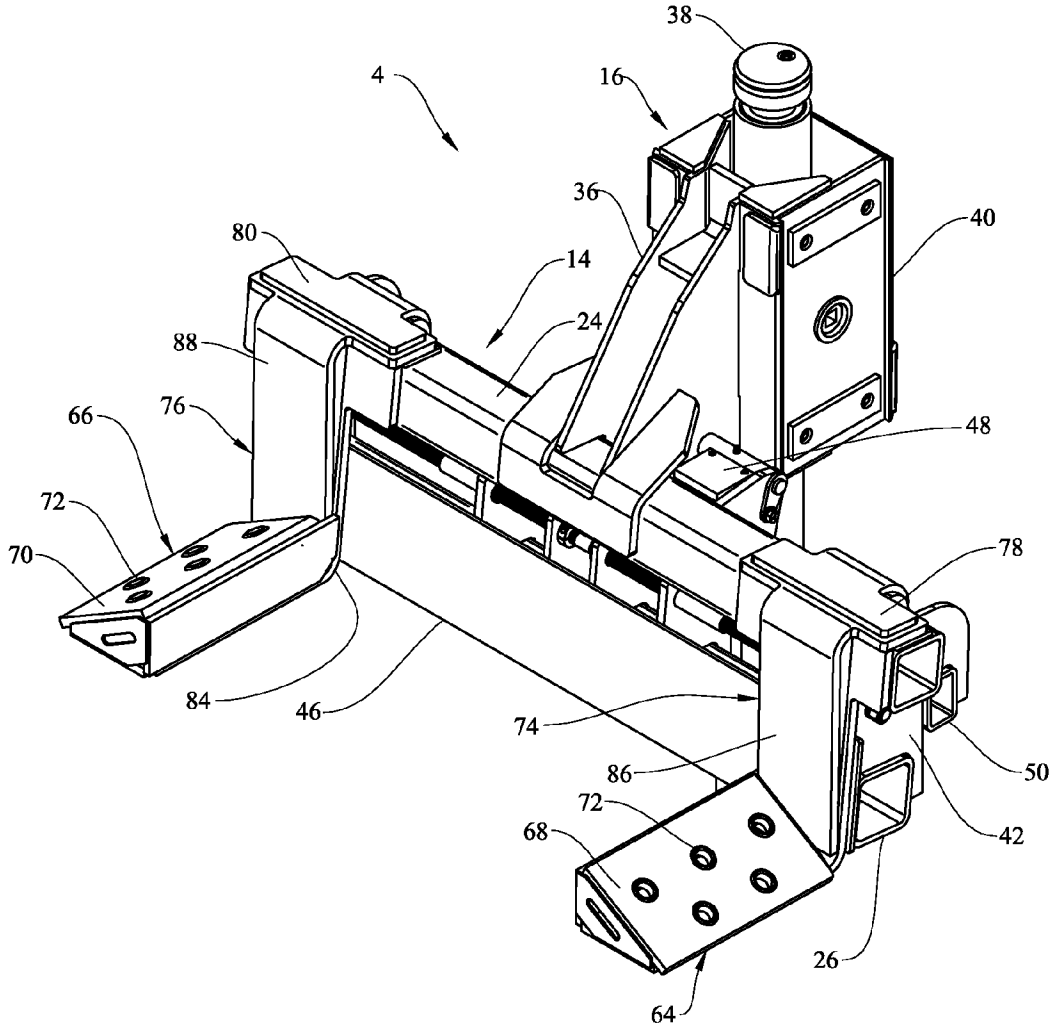
FIG. 2C is a front perspective view of the carriage assembly according to the embodiment of the present invention.
Figure 3B:
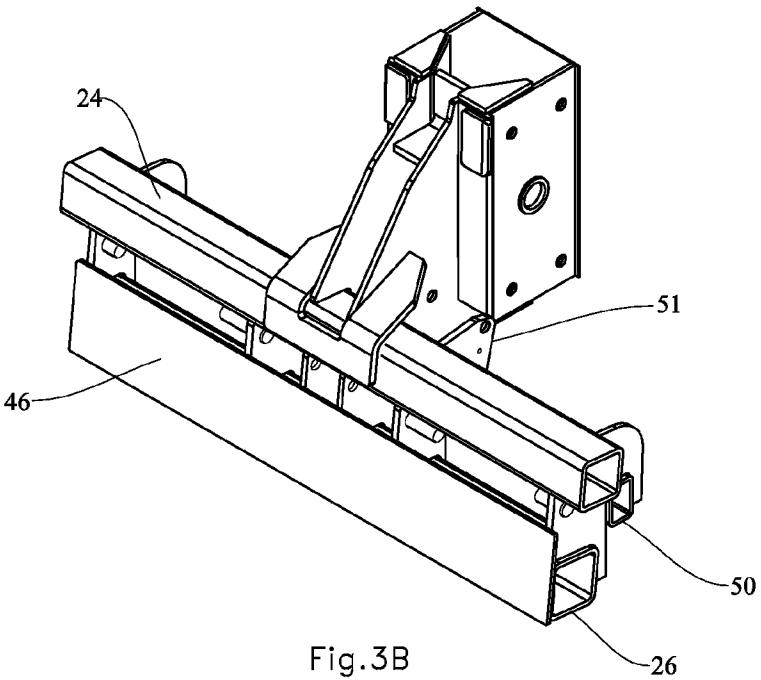
FIG. 3B is a front perspective view of the carriage assembly without first and second lift pad assemblies.
Figure 3A:
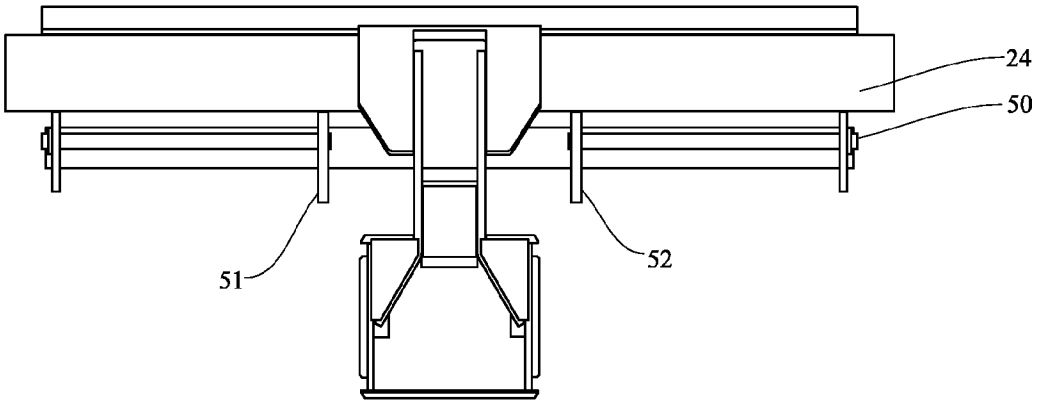
FIG. 3A is a top plan view of the carriage assembly without first and second lift pad assemblies.
Figure 4B:
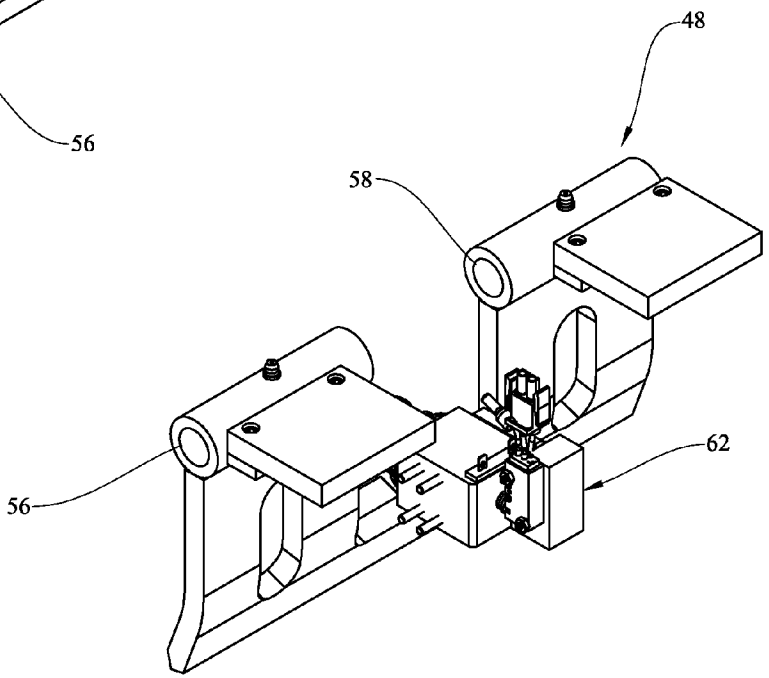
FIG. 4B is a rear perspective view of the stop assembly according to the embodiment of the present invention.
Figure 4A:
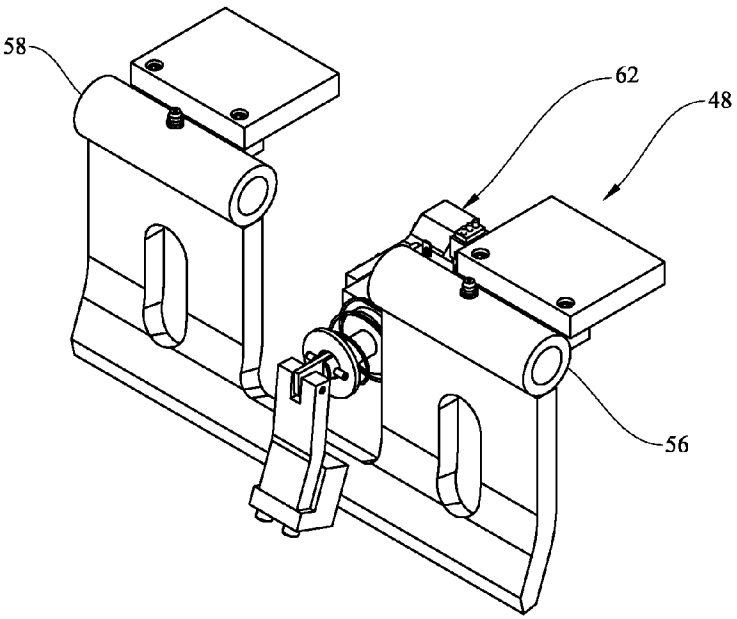
FIG. 4A is a front perspective view of a stop assembly according to the embodiment of the present invention.

The column mechanism 2 is a rigid column having a vertical channel 10 and a base member 12. The carriage assembly 4 includes a carriage section 14 and a vertical movement section 16 connected to the carriage section 14, as shown in FIG. 2C.

Figure 5:
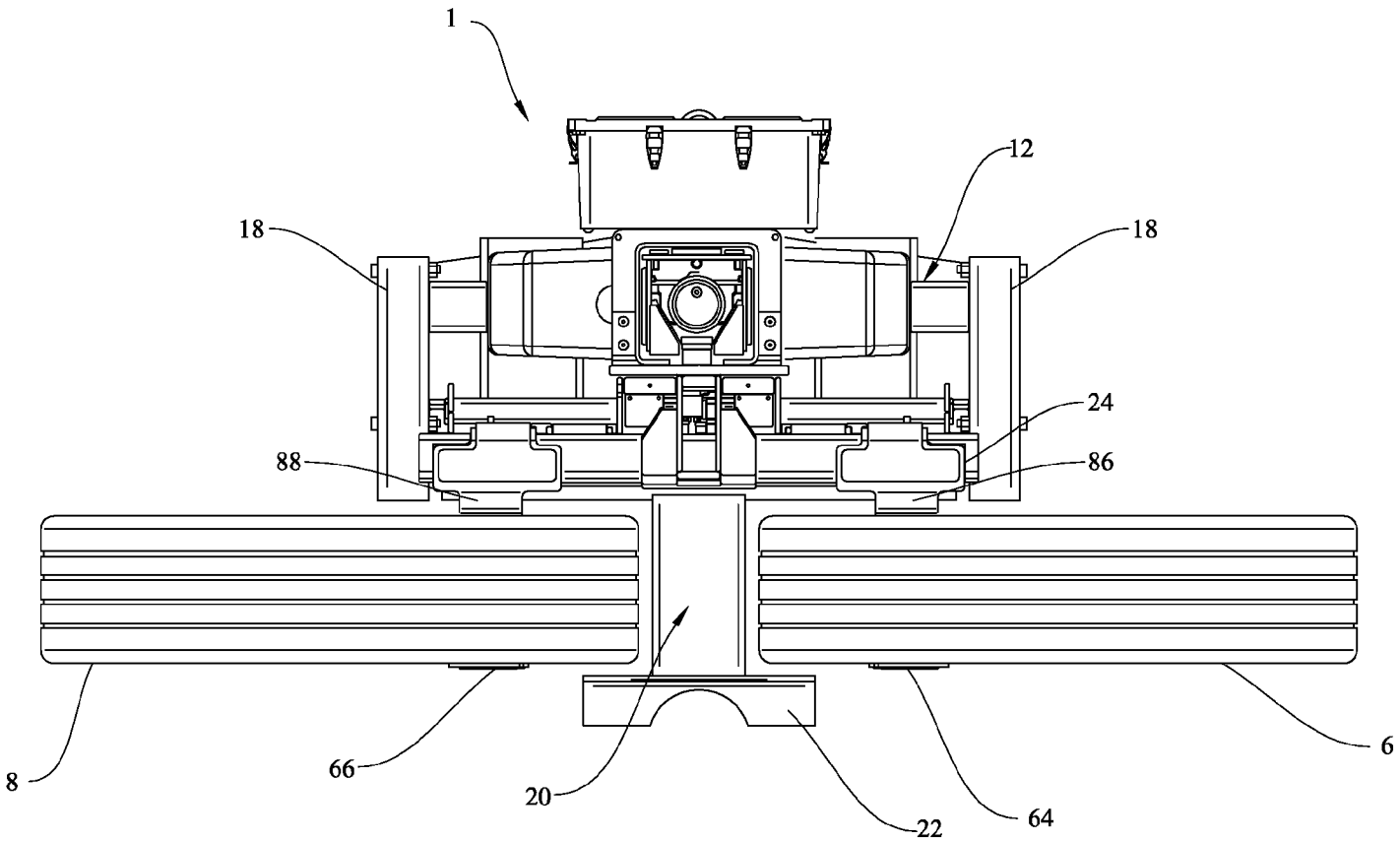
FIG. 5 is the top plan view of FIG. 1D with the multiple axle lift system engaging vehicle tires attached to separate axles.

The base member 12 of the column mechanism 2 includes lateral support members 18 and a central support member 20. The lateral support members 18 are shorter than the central support member 20 and provide more compact lateral ends of the base member 12. The central support member 20 extends away from the base member 12 to provide forward support for lifting vehicle tires 6, 8 attached to separate axles. The base member 12, including the central support member 20, is substantially T-shaped. Referring to FIG. 5, the central support member 20, in operation, reaches underneath the vehicle such that a corresponding one of the vehicle tires 6, 8 is located at or above each lateral side of the central support member 20. The central support member 20 optionally has an angled plate 22 disposed at a forward end portion of the central support member 20. The angled plate 22 adds support and stability to the lift system 1 when loaded with the vehicle tires 6, 8 attached to separate axles.

The carriage section 14 includes a top rail 24 and a bottom rail 26 that run generally parallel to each other and are both generally perpendicular to the vertical movement section 16. In the embodiment shown, the top and bottom rails 24, 26 are hollow to decrease weight.

The vertical movement section 16 is a rigid member and is slidably disposed in the vertical channel 10 of the column mechanism 2. The column mechanism 2 lifts the carriage assembly 4 via the vertical movement section 16 using means that are well known in the art, such as a hydraulic cylinder 38. The vertical movement section 16 includes a connecting arm 36 that connects the carriage section 14 to the vertical movement section 16 and a housing 40. Referring to FIG. 2C, the connecting arm 36 attaches to the top rail 24 and extends upwardly to the housing 40 where it connects with the housing 40. The housing 40 surrounds the hydraulic cylinder 38 and fits into the lift system 1 as shown in FIGS. 1A-1D. The vertical movement section 16 is slidably coupled to the column mechanism 2 of the lift system 1 and operates within the column mechanism 2 to lift and lower the carriage section 14 as is known in the art.

The carriage section 14 further includes a first side guard plate 42 disposed at a first end of the top and bottom rails 24, 26, and a second side guard plate 44 disposed at a second end of the top and bottom rails 24, 26 and a front guard plate 46. The first and second side guard plates 42, 44 are secured to at least the bottom rail 26 via, for example, welding, press fitting, etc. Along the front of the bottom rail 26, the front guard plate 42 is disposed. The front guard plate 46 runs along the same length as the bottom rail 10, but the width is greater such that the front guard plate 46 extends past the bottom rail 10 toward the top rail 24.

The carriage section 14 further includes a downstop assembly 48 disposed on a back side of the top rail 24. The downstop assembly 48 pivots on a downstop rod 54, which is located to the rear of the top and bottom rails 24, 26. Specifically, referring to FIG. 3A, a first brace 51 and a second brace 52 connect the top rail 24, bottom rail 26 and the rear rail 50 together. The first and second braces 51, 52 support the downstop assembly 48 while the downstop rod 54 holds the downstop assembly 48 between the first and second braces 51, 52. Referring to FIGS. 3A-3B and 4A-4B, the braces 51, 52 are disposed on respective sides of the centerline C. First and second hollow tubes 56, 58 are aligned with apertures on the braces 51, 52 and the connecting arm 36. The downstop rod 54 is secured through the apertures and through the hollow tubes 56, 58. Referring to FIGS. 1A-1D, the downstop assembly 48 interacts with a plurality of stops 60 on the column mechanism 2. Specifically, a maneuvering device 62 is mounted to the connecting arm 36. The maneuvering device 62 is used to pivot the downstop assembly 48 about the downstop rod 54 and thereby engage or disengage the stops 60.

In order to allow an operator to make simple adjustments to the carriage assembly 4, the carriage assembly 4 has a first lift pad assembly 64 and a second lift pad assembly 66 that are laterally movable. The first and second lift pad assemblies 64, 66 are laterally moveable towards or away from the centerline C to adjust for different vehicle tire diameters. The first and second lift pad assemblies 64, 66 may be moved into place manually, for example, and locked in their respective locations for engagement with the vehicle tires 6, 8. The central support member 20 is located between the lift pad assemblies 64, 66 and preferably substantially centered between the lift pad assemblies 64, 66. The first and second lift pad assemblies 64, 66 are laterally movable by being slidably coupled to the top rail 24.

To facilitate adjustment of the first and second lift pad assemblies 64, 66 to different vehicle tire diameters and to prevent side loading, the carriage assembly 4 can include a movement synchronizer that is operably connected to the first and second lift pad assemblies 64, 66 and moves the first and second lift pad assemblies 64, 66 laterally by translating rotational movement into lateral movement synchronously, as disclosed in U.S. patent application Ser. No. 12/894,695, which is incorporated by reference herein. This advantageously reduces the risk of side loading, which is undesirable in the use of the lift system 1.

Referring now to FIGS. 1A-1D and 5, the lift pad assemblies 64, 66 are configured to engage more than one vehicle tires 6, 8 in tandem for lifting. Referring to FIG. 5, in operation, the multiple axle lift system 1 does not have a tire disposed between inner sides of the lift pad assemblies 64, 66. Rather, the vehicle tires 6, 8 are disposed on outer sides of the lift pad assemblies 64, 66. In this embodiment, the lift pad assemblies 64, 66 each have lift pads 68, 70 that face away from each other. Specifically, the first lift pad 68 faces away from the second lift pad 70 and is angled so as to slope downwardly away from the centerline C. The second lift pad 70 faces away from the first lift pad 68 and is angled so as to slope downwardly away from the centerline C. The first and second lift pads 68, 70 are each configured to engage the vehicle tires 6, 8 in tandem, thereby allowing the lift system 1 to lift the vehicle tires 6, 8 at the same time, with the vehicle tires 6, 8 being on separate tandem axles. This advantageously provides a lift system 1 that is able to lift a portion of a vehicle with multiple axles without having to use a lift system 1 for each tire. In other words, with the lift system 1 of the present invention, the number of lift systems needed to lift an entire vehicle with dual axles, for example, is reduced from six to four. The embodiment of the present invention is also advantageous in that the point in which the carriage assembly 4 engages the vehicle tires 6, 8 to lift is selectable. That is, with the above-described adjustability of the first and second lift pad assemblies 64, 66, a user can cause the first and second lift pads 68, 70 of the carriage assembly 4 to engage the vehicle tires 6, 8 at a location closer or farther away from the point at which the surface of the tires 6, 8 are closest to each other. This is further advantageous when the vehicle tires 6, 8 are deflated. In this situation, the lift pad assemblies 64, 66 can compensate for the lack of pressure by spreading out further until resistance is met, even if the resistance is from the rims within the tires 6, 8.

Tread 72, such as protrusions or the like, is provided on an exterior surface of the lift pads 68, 70 to aid in gripping the vehicle tire 6, 8. The first and second lift pad assemblies 64, 66 each include a respective connecting arm 74, 76 and reinforcing plate 78, 80. The connecting arms 74, 76 extend upwardly from the lift pads 68, 70, respectively, and wrap around the top rail 24. Each of the connecting arms 74, 76 comprises a respective interior plate 82, 84 and exterior plate 86, 88. The interior plates 82, 84 support the under side of the lift pads 68, 70, respectively, and the exterior plates 86, 88 extend toward and wrap around the top rail 24. The reinforcing plates 78, 80 are disposed on top of the interior plate 82, 84.

In understanding the scope of the present invention, the term "comprising" and its derivatives, as used herein, are intended to be open ended terms that specify the presence of the stated features, elements, components, groups, and/or steps, but do not exclude the presence of other unstated features, elements, components, groups, and/or steps. The foregoing also applies to words having similar meanings such as the terms, "including", "having" and their derivatives. The terms of degree such as "substantially", "about" and "approximate" as used herein mean a reasonable amount of deviation of the modified term such that the end result is not significantly changed. For example, these terms can be construed as including a deviation of at least ±5% of the modified term if this deviation would not negate the meaning of the word it modifies.

It will be apparent to those skilled in the art from this disclosure that various changes and modifications can be made herein without departing from the scope of the invention. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such features. Thus, the foregoing descriptions of the embodiments according to the present invention are provided for illustration only, and not for the purpose of limiting the invention.

The invention claimed is:

1. A multiple axle lift system for lifting vehicle tires on separate axles comprising:

a column mechanism having a base member with a central support member extending therefrom; and a carriage assembly having a carriage section configured to engage the vehicle tires and slidably coupled to the column mechanism, the carriage section having a centerline and including first and second lift pad assemblies extending from the carriage section, the first lift pad assembly having a first lift pad for contacting a side of a first vehicle tire and the second lift pad assembly having a second lift pad for contacting a side of a second vehicle tire in tandem with the first vehicle tire, wherein said carriage section has a recessed opening that extends above a parallel plane of said first and second lift pads with said plane being located at a bottom portion of said first and second lift pads.

2. The multiple axle lift system of claim 1, wherein the first and second lift pads face away from the centerline of the carriage section.

3. The multiple axle lift system of claim 2, wherein the first and second lift pads slope downwardly and away from the centerline of the carriage section.

4. The multiple axle lift system of claim 1, wherein the first and second lift pad assemblies are movably disposed at the carriage assembly on opposite sides of the centerline.

5. The multiple axle lift system of claim 4, wherein the base member including the central support member is substantially T-shaped.

6. The multiple axle lift system of claim 4, wherein the base member further includes lateral support members disposed at ends of the base member.

7. The multiple axle lift system of claim 1, wherein the central support member includes an angled plate attached to a forward end portion of the central support member.

8. A multiple axle lift system for lifting tandem tires on tandem axles comprising: a column mechanism having a base member with a central support member extending therefrom; and a carriage assembly slidably connected to the column mechanism and including a centerline, a first lift pad assembly with a first lift pad for engaging a vehicle tire and a second lift pad assembly with a second lift pad for engaging a vehicle tire, the first and second lift pads are configured to face away from the centerline, wherein said carriage section has a recessed opening that extends above a parallel plane of said first and second lift pads with said plane being located at a bottom portion of said first and second lift pads.

9. The multiple axle lift system of claim 8, wherein the base member including the central support member is substantially T-shaped.

10. The multiple axle lift system of claim 8, wherein the central support member extends from the base member so as to be located between the lift pad assemblies.

11. The multiple axle lift system of claim 10, wherein the central support member is substantially centered between the lift pad assemblies.

12. The multiple axle lift system of claim 10, wherein the central support member includes an angled plate attached to a forward end portion of the central support member.

13. The multiple axle lift system of claim 8, wherein the central support member is configured to extend from the base member so as to reach underneath the vehicle such that a vehicle tire is located at each lateral side of the central support member at the time of lifting.

14. The multiple axle lift system of claim 8, wherein the base member includes lateral support members disposed at ends of the base member.

15. The multiple axle lift system of claim 8, wherein the first and second lift pads slope downwardly and away from the centerline.

16. A method of lifting vehicle tires on separate axles comprising:

positioning a column mechanism and a carriage assembly at a vicinity of the vehicle tires;

engaging the vehicle tires with a first lift pad assembly and a second lift pad assembly of the carriage assembly, wherein the vehicle tires are not disposed between the first and second lift pad assemblies;

forwardly supporting the column mechanism between the tires; and raising the carriage assembly with the column mechanism, wherein said carriage section has a recessed opening that extends above a parallel plane of said first and second lift pads with said plane being located at a bottom portion of said first and second lift pads which prevents said carriage assembly and said column mechanism from colliding.

17. The method of claim 16, wherein the engaging includes the first lift pad assembly engaging a first vehicle tire and the second lift pad assembly engaging a second vehicle tire.

* * * * *